US010128638B1

(12) United States Patent
Kawai et al.

(10) Patent No.: US 10,128,638 B1
(45) Date of Patent: Nov. 13, 2018

(54) IGNITION PLUG

(71) Applicant: NGK SPARK PLUG CO., LTD., Nagoya-shi, Aichi (JP)

(72) Inventors: Tomoki Kawai, Iwakura (JP); Ryoki Yagi, Komaki (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/975,024

(22) Filed: May 9, 2018

(30) Foreign Application Priority Data

May 11, 2017 (JP) ..... 2017-094691

(51) Int. Cl.
*H01T 13/20* (2006.01)
*H01T 21/02* (2006.01)

(52) U.S. Cl.
CPC ..... *H01T 13/20* (2013.01); *H01T 21/02* (2013.01)

(58) Field of Classification Search
CPC ..... H01T 13/14; H01T 13/20; H01T 13/02; H01T 13/32; H01T 21/02
See application file for complete search history.

(56) References Cited

U.S. PATENT DOCUMENTS 5,347,193 A * 9/1994 Oshinna ..... H01T 13/39 313/141
6,091,185 A * 7/2000 Matsubara ..... H01T 13/32 313/118
6,335,587 B1 * 1/2002 Matsubara ..... H01T 13/20 313/123
7,723,906 B2 * 5/2010 Kadowaki ..... H01T 13/38 313/143
8,212,462 B2 * 7/2012 Kato ..... H01T 13/20 313/118
2007/0210688 A1 9/2007 Suzuki et al.

FOREIGN PATENT DOCUMENTS

JP 2007-280942 A 10/2007

* cited by examiner

*Primary Examiner* — Anne M Hines
(74) *Attorney, Agent, or Firm* — Kusner & Jaffe

(57) ABSTRACT

An ignition plug includes an insulator having an outer-diameter reduction surface and a metal shell. The metal shell includes a rear end portion, a curved deformation portion, and a stepped portion. In a section including an axial line, the average hardness of a surface layer portion, which extends along a specific surface, of a rear end surface of the stepped portion is higher than the average hardness of the rear end portion and the average hardness of the deformation portion.

9 Claims, 7 Drawing Sheets

IGNITION PLUG

RELATED APPLICATIONS

This application claims the benefit of Japanese Patent Application No. 2017-094691, filed May 11, 2017, the entire contents of which are incorporated herein by reference.

FIELD OF THE INVENTION

The present invention relates to an ignition plug for igniting a fuel gas in, for example, an internal combustion engine.

DESCRIPTION OF THE INVENTION

An ignition plug is attached to, for example, an internal combustion engine and used for igniting a fuel gas inside a combustion chamber. In a publicly known structure of an ignition plug, a cylindrical metal shell includes a stepped portion disposed on an inner peripheral side thereof, and a cylindrical insulator includes an outer-diameter reduction portion where an outer diameter of the insulator is reduced. When a rear end portion of the metal shell is crimped during assembly, the outer-diameter reduction portion of the insulator disposed in a through hole of the metal shell is pressed against the stepped portion of the metal shell via a packing. As a result, air-tightness between the insulator and the metal shell is ensured (Japanese Unexamined Patent Application Publication No. 2007-280942).

Such an ignition plug has been required to be reduced in terms of diameter from a point of view of, for example, ensuring design flexibility of an internal combustion engine. However, a voltage to be applied to an ignition plug tends to become higher to improve an ignition property of the ignition plug; thus, the insulator is required to be increased in terms of thickness to ensure voltage resistance of the insulator, which makes it difficult to reduce the diameter of the insulator. Therefore, the metal shell tends to have a smaller thickness, which requires ensuring the strength of the metal shell.

Japanese Unexamined Patent Application Publication No. 2007-280942 discloses a technology of partially curing a metal shell by quenching a base end portion of thread ridges of the metal shell. According to Japanese Unexamined Patent Application Publication No. 2007-280942, such technology prevents the base end portion of the thread ridges from cracking or breaking during crimping while ensuring easy deformability of the rear end portion of the metal shell.

The technology in Japanese Unexamined Patent Application Publication No. 2007-280942, however, gives no consideration to the stepped portion of the metal shell, and thus, there is a possibility that the stepped portion is excessively deformed.

The present specification discloses a technology that suppresses deformation of a stepped portion of a metal shell in an ignition plug while ensuring easy deformability of a rear end portion of the metal shell.

SUMMARY OF THE INVENTION

The technology disclosed in the present specification can be implemented as the following examples.

Application Example 1

In accordance with a first aspect of the present invention, there is provided an ignition plug that includes an insulator that is a cylindrical body extending in a direction of an axial line and has an outer-diameter reduction surface where an outer diameter is reduced toward a front side; and a cylindrical metal shell that is disposed on an outer circumference of the insulator. The metal shell includes a rear end portion that is curved further toward an outer circumference surface of the insulator as the rear end portion becomes closer to a rear side, the rear end portion securing the insulator from the rear side directly or via another member, a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member. When in having projected the outer-diameter reduction surface of the insulator onto a rear end surface of the stepped portion along the axial line, the rear end surface includes a specific surface that is a surface overlapped by the projected outer-diameter reduction surface, in a section including the axial line, an average hardness of a surface layer portion extending along the specific surface is higher than an average hardness of the rear end portion and an average hardness of the deformation portion.

According to the aforementioned structure, the average hardness of the surface layer portion extending along the specific surface of the stepped portion is higher than the average hardness of the rear end portion and the average hardness of the deformation portion. As a result, it is possible to suppress deformation of the stepped portion of the metal shell while ensuring easy deformability of the rear end portion and the deformation portion of the metal shell. Therefore, for example, it is possible to suppress cracking of the rear end portion and the deformation portion when the rear end portion is crimped during assembly. Moreover, for example, it is possible to avoid a malfunction in which the insulator is damaged by the stepped portion deformed due to the force applied to the stepped portion by the outer-diameter reduction surface of the insulator.

Application Example 2

In accordance with a second aspect of the present invention, there is provided an ignition plug according to Application example 1, wherein the stepped portion includes the rear end surface, a front end surface positioned closer than the rear end surface to the front side and where an inner diameter is increased toward the front side, and an intermediate surface positioned between the rear end surface and the front end surface. In the section, when the stepped portion includes a first region between a line that indicates the specific surface and a straight line that passes through a front end of a line indicating the intermediate surface and that is perpendicular to the axial line, the first region extending radially inwardly from a straight line that passes through a radially outward end of the line indicating the specific surface and that extends along the axial line, an average hardness of the first region is higher than the average hardness of the rear end portion and the average hardness of the deformation portion.

According to the aforementioned structure, it is possible to further suppress the deformation of the stepped portion because the average hardness of the first region is higher than the average hardness of the rear end portion and the average hardness of the deformation portion.

Application Example 3

In accordance with a third aspect of the present invention, there is provided an ignition plug according to Application example 1 or 2, wherein the metal shell includes a screw portion formed in at least an area of an outer circumference surface of the metal shell, the area extending in the direction of the axial line and being where the rear end surface of the stepped portion is formed. In the section, when the screw portion includes a plurality of groove portions, the plurality of groove portions including a specific groove portion that is closest to a radially outward end of the rear end surface, when the screw portion includes a plurality of ridge portions, the plurality of ridge portions including two specific ridge portions that are adjacent to the specific groove portion, and when the metal shell includes a second region between two straight lines that pass through one of the specific ridge portions corresponding thereto and that are perpendicular to the axial line, the second region extending radially outwardly from a straight line that passes through the radially outward end of the rear end surface and that extends along the axial line, an average hardness of the second region is higher than the average hardness of the deformation portion and the average hardness of the rear end portion.

According to the aforementioned structure, it is possible to suppress screw tearing in a portion close to the specific groove portions of the screw portion because the average hardness of the second region is higher than the average hardness of the rear end portion.

Application Example 4

In accordance with a fourth aspect of the present invention, there is provided an ignition plug that includes an insulator that is a cylindrical body extending in a direction of an axial line and has an outer-diameter reduction surface where an outer diameter is reduced toward a front side; and a cylindrical metal shell that is disposed on an outer circumference of the insulator. The metal shell includes a rear end portion that is curved further toward an outer circumference surface of the insulator as the rear end portion becomes closer to a rear side, the rear end portion securing the insulator from the rear side directly or via another member; a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member. When in having projected the outer-diameter reduction surface of the insulator onto a rear end surface of the stepped portion along the axial line, the rear end surface includes a specific surface that is a surface overlapped by the projected outer-diameter reduction surface, in a section including the axial line, a martensite structure is included only in a region including at least the surface layer portion that extends along the specific surface and excluding the rear end portion and the deformation portion.

According to the aforementioned structure, the hardness of the surface layer portion of the stepped portion is higher than the hardness of the rear end portion and the hardness of the deformation portion because a martensite structure is included only in a region including at least the surface layer portion that extends along the specific surface and excluding the rear end portion and the deformation portion. As a result, it is possible to increase the strength of the stepped portion of the metal shell while ensuring easy deformability of the rear end portion and the deformation portion of the metal shell. Therefore, for example, it is possible to suppress cracking of the rear end portion and the deformation portion when the rear end portion is crimped during assembly. Moreover, for example, it is possible to avoid a malfunction in which the insulator is damaged by the stepped portion deformed due to the force applied to the stepped portion by the outer-diameter reduction surface of the insulator via a packing.

Application Example 5

In accordance with a fifth aspect of the present invention, there is provided an ignition plug according to Application example 4, wherein the stepped portion includes the rear end surface, a front end surface positioned closer than the rear end surface to the front side and where an inner diameter is increased toward the front side, and an intermediate surface positioned between the rear end surface and the front end surface. In the section, when the stepped portion includes a first region between a line that indicates the specific surface and a straight line that passes through a front end of a line indicating the intermediate surface and that is perpendicular to the axial line, the first region extending radially inwardly from a straight line that passes through a radially outward end of the line indicating the specific surface and that extends along the axial line, the first region includes the martensite structure.

According to the aforementioned structure, the hardness of the first region is higher than the hardness of the rear end portion and the hardness of the deformation portion because the first region includes the martensite structure. As a result, it is possible to further suppress the deformation of the stepped portion. Therefore, for example, it is possible to further suppress the deformation of the stepped portion.

Application Example 6

In accordance with a sixth aspect of the present invention, there is provided an ignition plug according to Application example 4 or 5, wherein the metal shell includes a screw portion formed in at least an area of an outer circumference surface of the metal shell, the area extending in the direction of the axial line and being where the rear end surface of the stepped portion is formed. In the section, when the screw portion includes a plurality of groove portions, the plurality of groove portions including a specific groove portion that is closest to a radially outward end of the rear end surface, when the screw portion includes a plurality of ridge portions, the plurality of ridge portions including two specific ridge portions that are adjacent to the specific groove portion, and when the metal shell includes a second region between two straight lines that pass through one of the specific ridge portions corresponding thereto and that are perpendicular to the axial line, the second region extending radially outwardly from a straight line that passes through the radially outward end of the rear end surface and that extends along the axial line, the second region includes the martensite structure.

According to the aforementioned structure, the hardness of the second region is higher than the hardness of the rear end portion because the second region includes the martensite structure. As a result, it is possible to suppress screw tearing in a portion close to the groove portions of the screw portion.

Application Example 7

In accordance with a seventh aspect of the present invention, there is provided an ignition plug according to any one of Application example 1 to 6, wherein the screw portion has a diameter less than or equal to M12.

When the screw portion has a diameter less than or equal to M12, the thickness of the metal shell and the thickness of the stepped portion tend to be thin, which increases the necessity of suppressing deformation of the stepped portion. According to the aforementioned structure, it is possible to suppress the deformation of the stepped portion in the ignition plug, in which the necessity of suppressing the deformation of the stepped portion is high.

Application Example 8

In accordance with an eighth aspect of the present invention, there is provided a method of manufacturing the ignition plug, according to any one of Application examples 1 to 7, that includes a first step of preparing the metal shell and the insulator, a second step of subjecting only a first portion of the metal shell to quenching; and a third step of assembling the insulator onto the metal shell after the quenching. The third step includes crimping a rear end of the metal shell to form the rear end portion and the deformation portion; and pressing the outer-diameter reduction surface of the insulator against the rear end surface directly or via another member. In a section of a spark plug intermediate body after the third step, the first portion includes the surface layer portion extending along the specific surface of the stepped portion, and a second portion, other than the first portion, includes portions that are deformed in the third step into the rear end portion and the deformation portion.

According to the aforementioned structure, it is possible to avoid a malfunction caused by excessive deformation of the stepped portion while suppressing cracking of the rear end portion and the deformation portion during crimping in the third step.

Application Example 9

In accordance with a ninth aspect of the present invention, there is provided a method of manufacturing the ignition plug, according to any one of Application examples 1 to 7, that includes a first step of preparing the metal shell and the insulator, the metal shell including a quenched portion, the quenched portion including a first portion and a second portion; a second step of subjecting only the second portion of the metal shell to tempering; and a third step of assembling the insulator onto the metal shell after the tempering. The third step includes crimping a rear end of the metal shell to form the rear end portion and the deformation portion; and pressing the insulator against the rear end surface directly or via another member. In a section of a spark plug intermediate body after the third step, the first portion includes the surface layer portion extending along the specific surface of the stepped portion, and the second portion, other than the first portion, includes portions that are deformed in the third step into the rear end portion and the deformation portion.

According to the aforementioned structure, it is possible to avoid a malfunction caused by excessive deformation of the stepped portion while suppressing cracking of the rear end portion and the deformation portion during crimping in the third step.

The technology disclosed in the present specification can be implemented in various forms. For example, the technology can be implemented in the form of an ignition plug, an ignition device that uses the ignition plug, an internal combustion engine on which the ignition plug is mounted, an internal combustion engine on which the ignition device that uses the ignition plug is mounted, an electrode of the ignition plug, or the like.

DETAILED DESCRIPTION OF THE INVENTION

A. First Embodiment

A-1. Structure of Ignition Plug

Figure 1:
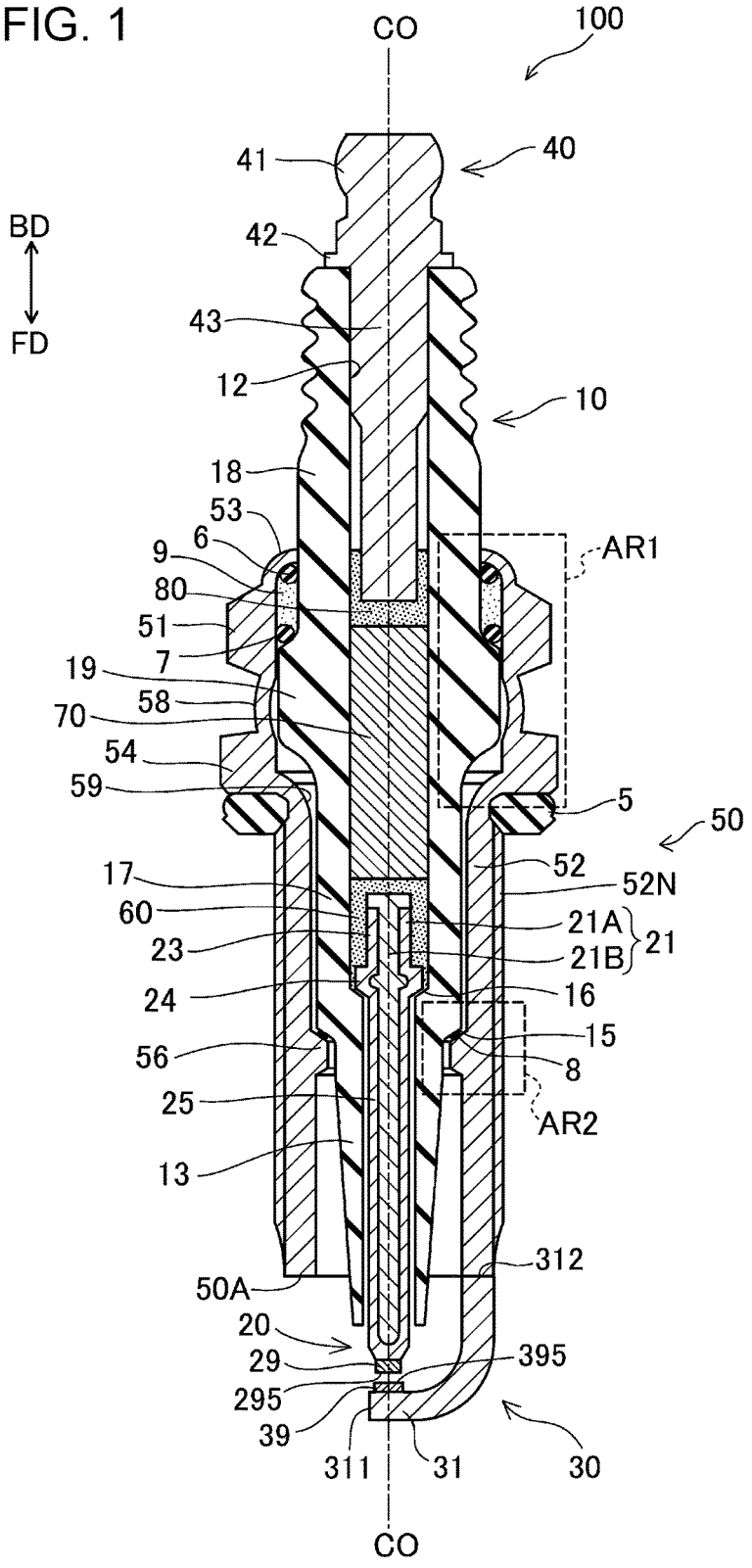
FIG. 1 illustrates a cross section including an axial line CO of an ignition plug.

FIG. 1 illustrates a cross section including an axial line CO of an ignition plug 100 according to the first embodiment. The axial line CO of the ignition plug 100 is indicated by an alternating long-and-short dash line in FIG. 1. A direction (up-down direction in FIG. 1) parallel to the axial line CO is also referred to as an axial line direction. The radial direction of a circle that has the axial line CO as the center thereof and has a face perpendicular to the axial line CO is also simply referred to as a radial direction. The circumferential direction of the circle is also simply referred to as a circumferential direction. The downward direction in FIG. 1 is also referred to as a front end direction FD and the upward direction in FIG. 1 is also referred to as a rear end direction BD. The lower side in FIG. 1 is referred to as the front side of the ignition plug 100, and the upper side in FIG. 1 is referred to as the rear side of the ignition plug 100.

The ignition plug 100 causes electric discharge in a clearance (discharge gap) formed between a center electrode 20 and a ground electrode 30. The center electrode 20 and the ground electrode 30 will be described later in detail. The ignition plug 100 is attached to an internal combustion engine and used for igniting a fuel gas inside a combustion chamber of the internal combustion engine. The ignition plug 100 includes an insulator 10 as an insulating material, the center electrode 20, the ground electrode 30, a metal terminal 40, a metal shell 50, and a gasket 5.

The insulator 10 is formed by sintering, for example, alumina. The insulator 10 is a substantially cylindrical member that has an axial hole 12. The axial hole 12 is a through hole that extends in the axial line direction through the insulator 10. The insulator 10 includes a flange portion 19, a rear trunk portion 18, a front trunk portion 17, and a leg portion 13. The rear trunk portion 18 is positioned closer than the flange portion 19 to the rear side and has an outer diameter less than the outer diameter of the flange portion 19. The front trunk portion 17 is positioned closer than the flange portion 19 to the front side and has an outer diameter less than the outer diameter of the flange portion 19. The leg portion 13 is positioned closer than the front trunk portion 17 to the front side and has an outer diameter less than the outer diameter of the front trunk portion 17. The leg portion 13 is exposed to the combustion chamber of the internal combustion engine (not shown) when the ignition plug 100 is attached to the internal combustion engine. An outer-diameter reduction surface 15 (step portion) where the outer diameter of the insulator is reduced toward the front side is formed between the leg portion 13 and the front trunk portion 17.

The metal shell 50 is formed of a conductive metal material, specifically, a carbon steel material. The metal shell 50 is a cylindrical shell for securing the ignition plug 100 onto an engine head (not shown) of the internal combustion engine. The metal shell 50 has a through hole 59 that extends along axial line CO through the metal shell 50. The metal shell 50 is disposed around the insulator 10 in the radial direction, that is, on the outer circumference of the insulator 10. In other words, the insulator 10 is inserted and held in the through hole 59 of the metal shell 50. The front end of the insulator 10 protrudes further than the front end of the metal shell 50 toward the front side. The rear end of the insulator 10 protrudes further than the rear end of the metal shell 50 toward the rear side.

The metal shell 50 includes a tool engagement portion 51 having a hexagonal cylindrical shape and with which an ignition plug wrench engages, an attachment portion 52 for attaching the internal combustion engine, and a jutting portion 54 formed between the tool engagement portion 51 and the attachment portion 52.

The attachment portion 52 includes a screw portion 52N formed on the outer circumference surface thereof. The attachment portion 52 in a state in which the ignition plug 100 is attached to the internal combustion engine is screwed with a screw hole (not shown) formed in the engine head of the internal combustion engine. The nominal diameter of the screw portion 52N is, for example, M12 or less, such as M12, M10, or M8.

The jutting portion 54 is a flange-shaped portion jutting out radially outwardly from the rear side of the attachment portion 52. As will be described later, the jutting portion 54 in the state in which the ignition plug 100 is attached to the internal combustion engine is connected to the entire circumference of an attachment surface of the internal combustion engine with the gasket 5 interposed therebetween.

The metal annular gasket 5 described in detail later is inserted between the jutting portion 54 and the attachment portion 52 of the metal shell 50. The gasket 5 in the state in which the ignition plug 100 is attached to the internal combustion engine seals a clearance between the ignition plug 100 and the internal combustion engine (engine head).

The metal shell 50 also includes a thin rear end portion 53 and a thin deformation portion 58. The rear end portion 53 is formed at the rear side of the tool engagement portion 51. The deformation portion 58 is formed between the jutting portion 54 and the tool engagement portion 51. Annular ring members 6 and 7 are disposed in an annular region that is formed between the outer circumference surface of the rear trunk portion 18 of the insulator 10 and the inner circumference surface of a portion of the metal shell 50, the portion including the tool engagement portion 51 and the rear end portion 53. A space between the ring members 6 and 7 in the region is filled with talc (talcum) 9 in a power form.

The metal shell 50 also includes a stepped portion 56 formed at the inner circumference of the attachment portion 52. In other words, the screw portion 52N is formed in an area of the outer circumference surface of the metal shell 50, the area extending in the axial line direction and including the stepped portion 56. The stepped portion 56 supports the outer-diameter reduction surface 15 of the insulator 10 with an annular metal plate packing 8 interposed therebetween. The metal shell 50 will be described later in detail.

The center electrode 20 includes a rod-shaped center electrode body 21 extending in the axial line direction and a center electrode tip 29. The center electrode body 21 is held inside the axial hole 12 of the insulator 10 so as to be at a front side portion of the axial hole 12. The center electrode body 21 has a structure that includes an electrode base material 21A and a core portion 21B embedded inside the electrode base material 21A. The electrode base material 21A is formed of, for example, nickel or an alloy (for example, NCF600 or NCF601) containing nickel as a main component. The core portion 21B is formed of copper, which is superior to the alloy that forms the base material 21A in heat conductivity, or is formed of an alloy containing copper as a main component. The core portion 21B in the first embodiment is formed of copper.

The center electrode body 21 includes a flange portion 24 (flange portion), a head portion 23 (electrode head portion), and a leg portion 25 (electrode leg portion). The flange portion 24 is formed at a predetermined location in the axial line direction. The head portion 23 is closer than the flange portion 24 to the rear side. The leg portion 25 is closer than the flange portion 24 to the front side. The flange portion 24 is supported by a step portion 16 of the insulator 10. The front end portion of the leg portion 25, that is, the front end of the center electrode body 21 protrudes further than the front end of the insulator 10 toward the front side.

The center electrode tip 29 is a substantially columnar member and joined to the front end (front end of the leg portion 25) of the center electrode body 21 by, for example, laser beam welding. The center electrode tip 29 is formed of a material containing, as a main component, a noble metal having a high melting point. The center electrode tip 29 is a noble metal tip formed of, for example, iridium (Ir), a noble metal including Ir, or an alloy containing the noble metal as a main component.

The ground electrode 30 includes a square column-shaped ground electrode tip 39 and a ground electrode body 31 joined to the front end of the metal shell 50. The ground electrode body 31 is a curved rod-shaped body having a square section. The ground electrode body 31 has a free end surface 311 and a joined end surface 312, as both end surfaces thereof. The joined end surface 312 is joined to a surface 50A, which is on the front side, of the metal shell 50 by, for example, resistance welding. Thus, the metal shell 50 and the ground electrode body 31 are electrically connected to each other.

The ground electrode body 31 is formed of nickel or an alloy (for example, NCF 600 or NCF601) containing nickel as a main component. The ground electrode body 31 may have a two-layer structure that includes a base material that is formed of metal (for example, a nickel alloy) having high corrosion-resistance and a core portion that is formed of metal (for example, copper) having high heat conductivity and is embedded in the base material. Similarly to the center electrode tip 29, the ground electrode tip 39 is a noble metal tip formed of, for example, iridium (Ir), a noble metal including Ir, or an alloy containing the noble metal as a main component. The ground electrode tip 39 is joined to a rear side surface, which is close to the free end surface 311, of the ground electrode body 31 by, for example, laser beam welding or resistance welding.

A first discharge surface 295 is a front side surface of the center electrode tip 29. A second discharge surface 395 is a rear end surface of the ground electrode tip 39. The first discharge surface 295 and the second discharge surface 395 form the aforementioned discharge gap.

The metal terminal 40 is a rod-shaped member extending in the axial line direction. The metal terminal 40 is formed of a conductive metal material (for example, low-carbon steel). The metal terminal 40 has a surface on which a metal layer (for example, a Ni layer) for corrosion prevention is formed by, for example, plating. The metal terminal 40 includes a flange portion 42 (terminal jaw portion), a cap installation portion 41, and a leg portion 43 (terminal leg portion). The flange portion 42 is formed at a predetermined location in the axial line direction. The cap installation portion 41 is positioned closer than the flange portion 42 to the rear side. The leg portion 43 is positioned closer than the flange portion 42 to the front side. The cap installation portion 41 of the metal terminal 40 is exposed by extending further than the insulator 10 toward the rear side. The leg portion 43 of the metal terminal 40 is inserted into the axial hole 12 of the insulator 10. After a plug cap to which a high-voltage cable (not shown) is connected is installed on the cap installation portion 41, a high voltage for causing electric discharge is applied to the cap installation portion 41.

A resistor 70 for reducing radio wave noise generated during electric discharge is disposed inside the axial hole 12 of the insulator 10 so as to be positioned between the front end (front end of the leg portion 43) of the metal terminal 40 and the rear end (rear end of the head portion 23) of the center electrode 20. The resistor 70 is formed of, for example, a composition containing glass particles as a main component, ceramic particles formed of a substance other than glass, and a conductive material. A clearance between the resistor 70 and the center electrode 20 inside the axial hole 12 is filled with a conductive seal 60. A clearance between the resistor 70 and the metal terminal 40 is filled with a conductive seal 80. Each of the conductive seals 60 and 80 is formed of, for example, a composition containing glass particles and metal (for example, Cu or Fe) particles.

A-2. Structure of Metal Shell 50

Figure 2B:
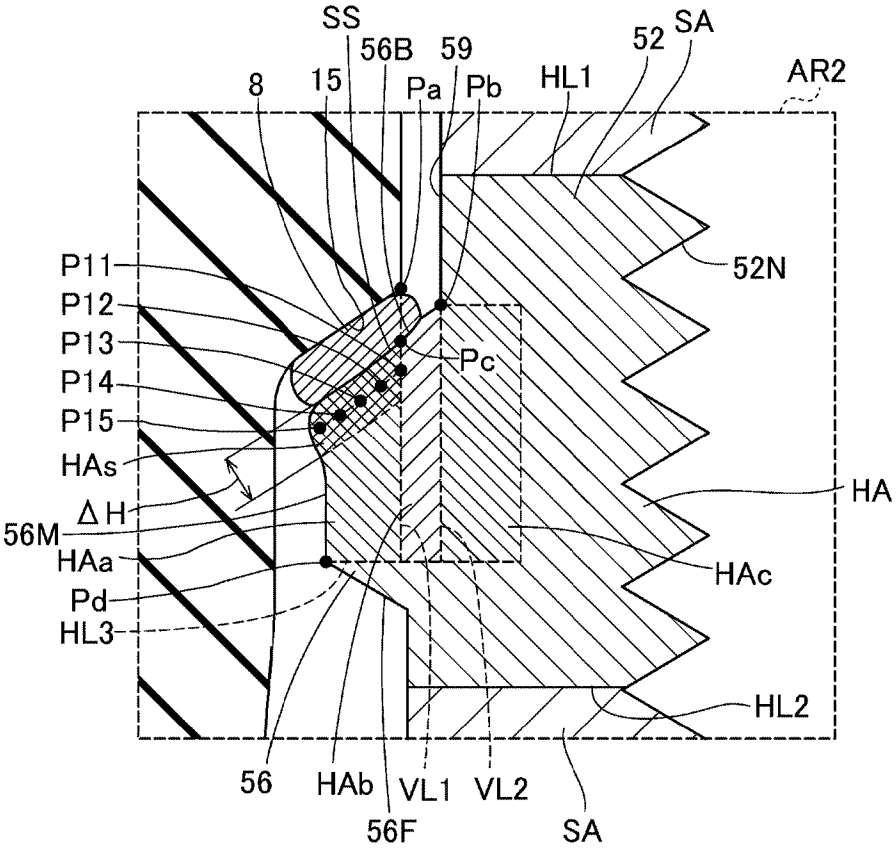
FIGS. 2A and 2B are first explanatory views of a metal shell.
Figure 2A:
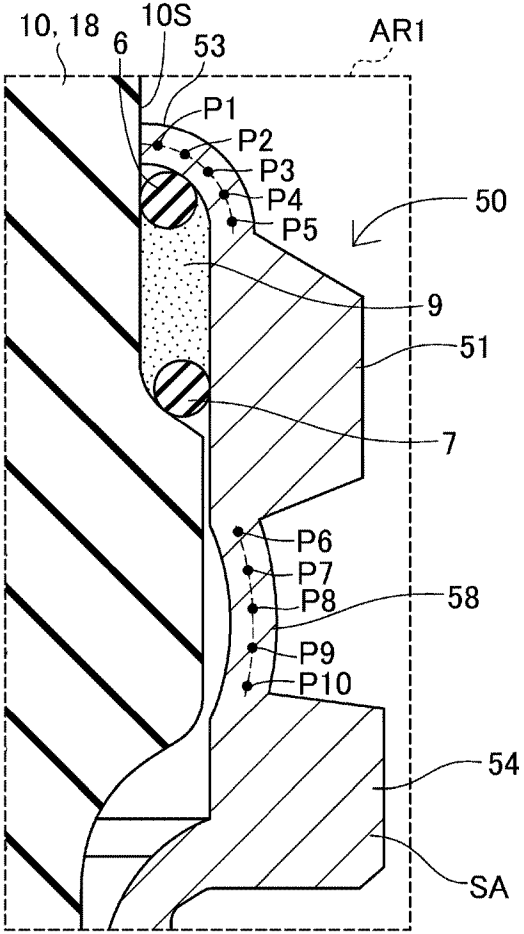

FIGS. 2A and 2B are first explanatory views of the metal shell 50. FIG. 2A is an enlarged view of a region AR1 in FIG. 1. The region AR1 is a portion that includes the rear end portion 53, the tool engagement portion 51, the deformation portion 58, and the jutting portion 54 of the metal shell 50.

When being crimped during manufacturing, the rear end portion 53 is curved further toward an outer circumference surface 10S of the insulator 10 (rear trunk portion 18) as the rear end portion 53 becomes closer to the rear side. The rear end of the rear end portion 53 is in contact with the outer circumference surface 10S of the insulator 10.

The deformation portion 58 is positioned closer than the rear end portion 53 to the front side. The deformation portion 58 is curved so as to jut out radially outwardly (right side in FIG. 2A).

FIG. 2B is an enlarged view of a region AR2 in FIG. 1. The region AR2 is a portion of the attachment portion 52 of the metal shell 50, the portion being close to the stepped portion 56. The stepped portion 56 is positioned closer than the aforementioned rear end portion 53 and deformation portion 58 to the front side. The stepped portion 56 juts out radially inwardly (left side in FIG. 2B) from an inner circumference surface of the stepped portion 56, the inner circumference surface forming the through hole 59 of the metal shell 50 (attachment portion 52).

The stepped portion 56 has a substantially trapezoidal shape in the cross section. The stepped portion 56 includes a rear end surface 56B, a front end surface 56F, which is positioned closer than the rear end surface 56B to the front side, and an intermediate surface 56M, which is positioned between the rear end surface 56B and the front end surface 56F.

The rear end surface 56B supports, from the front side, the outer-diameter reduction surface 15 of the insulator 10 with the plate packing 8 interposed therebetween. The stepped portion 56 includes a portion close to the rear end surface 56B, the portion being deformed due to a pressure applied by the insulator 10 via the annular metal plate packing 8. Thus, the portion close to the rear end surface 56B of the stepped portion 56 has a distorted trapezoidal shape.

The metal shell 50 includes a high-hardness portion HA and a low-hardness portion SA.

The high-hardness portion HA is positioned between straight lines HL1 and HL2 perpendicular to the axial line CO in the cross section in FIG. 2B. The high-hardness portion HA is a portion the entire circumference of which has been subjected to partial quenching, which will be described later. A martensite structure is formed in the high-hardness portion HA due to the quenching. The high-hardness portion HA may include a remnant structure (for example, ferrite structure, cementite structure, or austenite structure) that has not phase transformed into the martensite structure.

The low-hardness portion SA is a portion other than the high-hardness portion HA. In other words, in the cross section, the low-hardness portion SA includes a portion extending from the aforementioned straight line HL1 toward the rear side and a portion extending from the aforementioned straight line HL2 toward the front side. The low-hardness portion SA is a portion that is not subjected to partial quenching. The low-hardness portion SA does not include a martensite structure and includes, for example, a ferrite structure and a cementite structure.

The hardness of the high-hardness portion HA is higher than the hardness of the low-hardness portion SA. For example, the Vickers hardness of the high-hardness portion HA is 400 to 500 Hv, and the Vickers hardness of the low-hardness portion SA is 150 to 300 Hv. The Vickers hardness of the high-hardness portion HA is preferably higher than the Vickers hardness of the low-hardness portion SA by at least 100 Hv. Note that a boundary between the high-hardness portion HA and each portion of the low-hardness portion SA is temporarily indicated by the straight lines HL1 and HL2 in FIG. 2B, although each boundary is actually not straight and not clearly recognizable. The same applies to FIGS. 3A, 3B, and 6.

As illustrated in FIG. 2A, in the first embodiment, the low-hardness portion SA includes the whole rear end portion 53, the whole deformation portion 58, the whole tool engagement portion 51, and the whole jutting portion 54. As illustrated in FIG. 2A, the low-hardness portion SA also includes a portion of the attachment portion 52, the portion extending from the straight line HL1 toward the rear side, and a portion of the attachment portion 52, the portion extending from the straight line HL2 toward the front side.

As illustrated in FIG. 2B, in the first embodiment, the high-hardness portion HA includes the whole stepped portion 56 and a portion of the attachment portion 52. The portion of the attachment portion 52 includes an area extending in the axial line direction and where the stepped portion 56 is positioned, the portion of the attachment portion 52 being closer than the stepped portion 56 to the radial direction outside.

More specifically, the high-hardness portion HA includes an inner region HAa and an outer region HAb of the stepped portion 56.

Here, when the outer-diameter reduction surface 15 of the insulator 10 is projected onto the rear end surface 56B of the stepped portion 56 along the axial line CO, a specific surface SS is a surface overlapped by the projected outer-diameter reduction surface 15. That is, when a straight line that passes through a radially outward end Pa of the outer-diameter reduction surface 15 and extends along the axial line CO is denoted by a straight line VL1, the specific surface SS is a portion of the rear end surface 56B extending radially inwardly from the straight line VL1. That is, the straight line VL1 is a straight line that passes through a radially outward end Pc of the specific surface SS and extends along the axial line CO.

In the cross section, the inner region HAa is a region between the specific surface SS and the straight line HL3 that passes through a front end Pd of the line indicating the intermediate surface 56M and is perpendicular to the axial line CO, the inner region HAa extending radially inwardly from the aforementioned straight line VL1.

The inner region HAa includes a surface layer portion HAs. The surface layer portion HAs is a portion extending along the specific surface SS in the cross section. More specifically, the surface layer portion HAs extends along the specific surface SS and has a thickness of AH, where AH is 0.5 mm.

The outer region HAb is a region surrounded by the outer-diameter reduction surface 15, the aforementioned straight line VL1, the aforementioned straight line HL3, and a straight line VL2. The straight line VL2 extends along the axial line CO and passes through an end Pb, which is positioned radially outside of the outer-diameter reduction surface 15.

The high-hardness portion HA also includes a region HAc of the attachment portion 52, the region HAc being adjacent to the stepped portion 56. The region HAc adjacent to the stepped portion 56 is a rectangular portion adjacent to the radially outside of the aforementioned outer region HAb of the stepped portion 56.

Figure 3A:
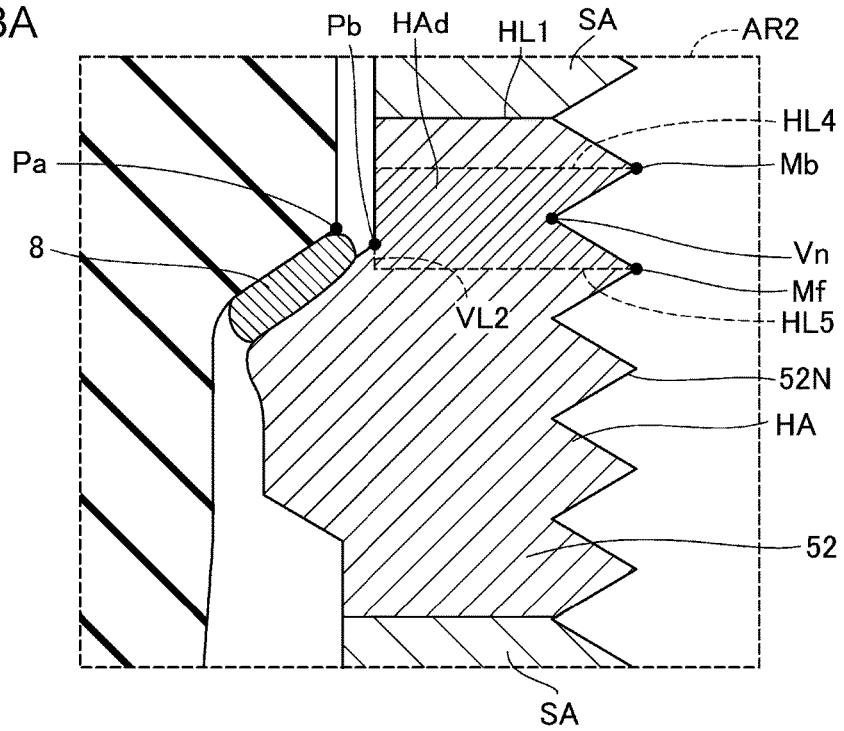
FIGS. 3A and 3B are second explanatory views of the metal shell.
Figure 3B:
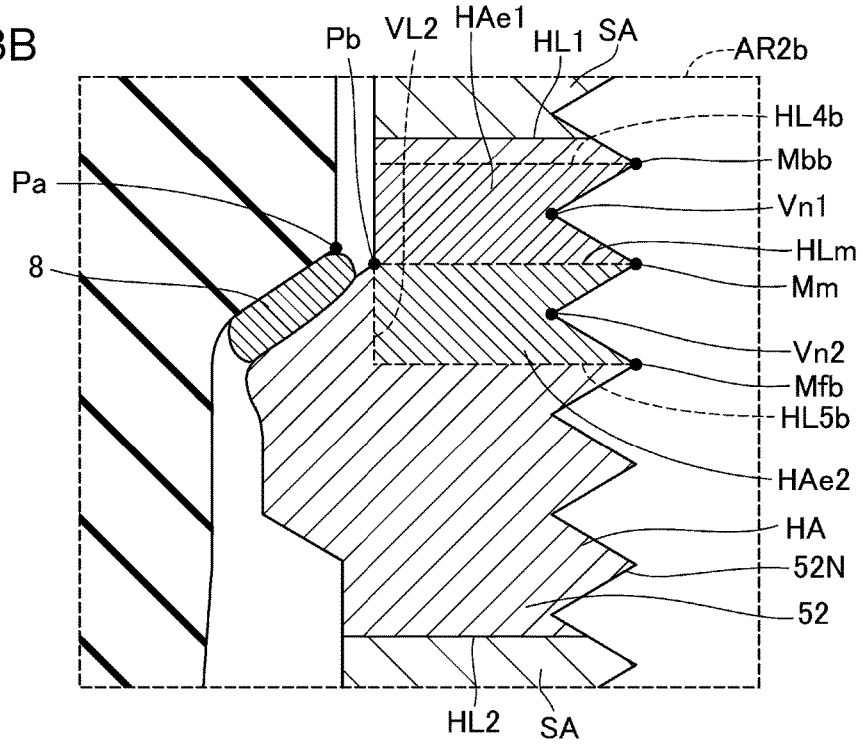

FIGS. 3A and 3B are second explanatory views of the metal shell 50. FIG. 3A illustrates the same section as the section in FIG. 2B. The high-hardness portion HA also includes a region HAd of the attachment portion 52, the region HAd being close to the rear end of the stepped portion 56. The screw portion 52N includes a plurality of groove portions. In the cross section, one of the groove portions closest to the radially outward end Pb of the rear end surface 56B (in other words, a rear end Pb of the stepped portion 56) is denoted by a specific groove portion Vn. The screw portion 52N includes a plurality of ridge portions. In the cross section, the ridge portion adjacent to the rear side of the specific groove portion Vn and the ridge portion adjacent to the front side of the specific groove portion Vn are denoted by a specific ridge portion Mb and a specific ridge portion Mf, respectively. Here, the region HAd close to the rear end of the stepped portion 56 is a region between straight lines HL4 and HL5. The straight lines HL4 and HL5 pass through the specific ridge portions Mb and Mf, respectively, and are perpendicular to the axial line CO. The region HAd extends radially outwardly from the aforementioned straight line VL2.

FIG. 3B illustrates a section including the axial line CO. The section is taken at a position that is different in circumferential position from FIG. 3A. In the section, groove portions Vn1 and Vn2 are the specific groove portions closest to the radially outward end Pb of the rear end surface 56B. In this case, the high-hardness portion HA includes regions HAe1 and HAe2 that are close to the rear end of the stepped portion 56.

The region HAe1 close to the rear end of the stepped portion 56 is a region between straight lines HL4*b* and HLm, which pass through specific ridge portions Mbb and Mm, respectively, and are perpendicular to the axial line CO. The specific ridge portion Mbb is adjacent to the rear side of the specific groove portion Vn1, and the specific ridge portion Mm is adjacent to the front side of the groove portion Vn1. The region HAe1 close to the rear end of the stepped portion 56 extends radially outwardly from the aforementioned straight line VL2. The region HAe2 close to the rear end of the stepped portion 56 is a region between straight lines HLm and HL5*b*, which pass through the specific ridge portion Mm and a specific ridge portion Mfb, respectively, and are perpendicular to the axial line CO. The specific ridge portion Mm is adjacent to the rear side of the specific groove portion Vn2, and the specific ridge portion Mfb is adjacent to the front side of the specific groove portion Vn2. The region HAe2 close to the rear end of the stepped portion 56 extends radially outwardly from the aforementioned straight line VL2.

A-3. Method of Manufacturing Ignition Plug 100

Figure 4:
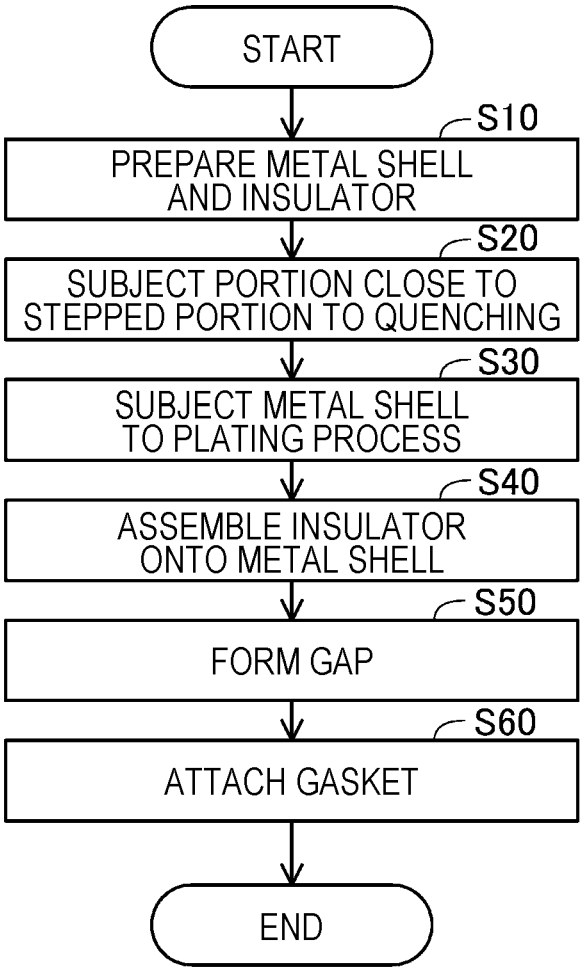
FIG. 4 is a flow chart showing manufacturing steps of an ignition plug according to a first embodiment.

Next, a method of manufacturing the ignition plug 100, mainly a method of manufacturing the metal shell 50, will be described. FIG. 4 is a flowchart showing steps of manufacturing the ignition plug 100 according to the first embodiment.

In S10, a metal shell 50*m*, which is in a pre-crimping state, and the insulator 10 are prepared. The metal shell 50*m* is formed of carbon steel and includes the ground electrode 30 welded thereto. The screw portion 52N (thread ridges) has been formed on the metal shell 50*m* but has not been plated. Members (center electrode 20, conductive seals 60 and 80, resistor 70, and metal terminal 40) have been pre-assembled into the axial hole 12 of the insulator 10.

In S20, partial quenching is performed on a portion of the metal shell 50*m*, the portion being close to the stepped portion 56, to form the aforementioned high-hardness portion HA. In the first embodiment, laser beam quenching that irradiates the metal shell 50 with a laser beam from the outer circumferential side or the inner circumferential side of the metal shell 50 is performed. The laser beam quenching is a publicly known technique, and thus will not be described in detail.

In S30, after being subjected to laser beam quenching, the metal shell 50*m* is subjected to a plating process to have a plated surface. The plating is, for example, Ni plating or Zn plating. As described above, the plating process is performed after quenching; because the plating may peel off if quenching is performed after the plating process. In addition, as described above, the screw portion 52N (thread ridges) is formed before a quenching process; because if formation of the screw portion 52N is attempted after the quenching process, it is not possible to perform a rolling process for forming the screw portion 52N due to the excessively high hardness of the metal shell 50*m*.

Figure 5B:
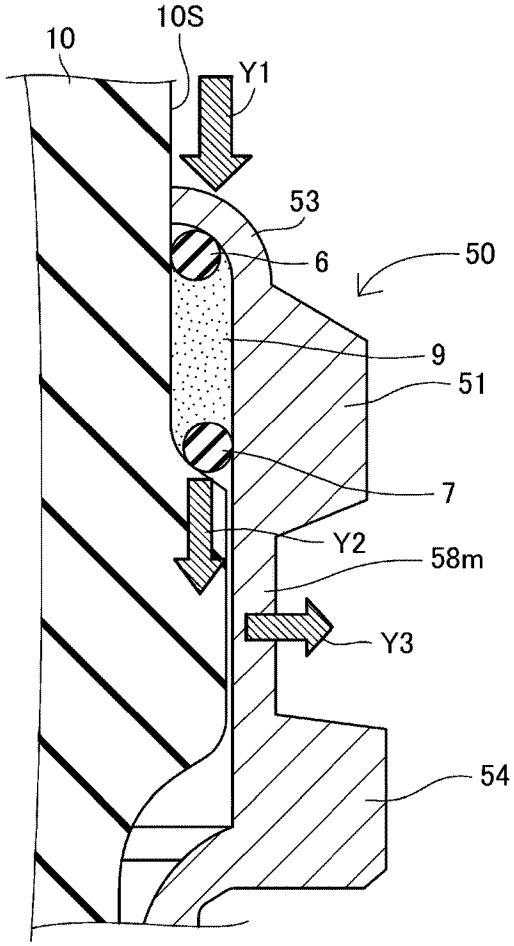
FIGS. 5A and 5B are first explanatory views of crimping of the metal shell.
Figure 5A:
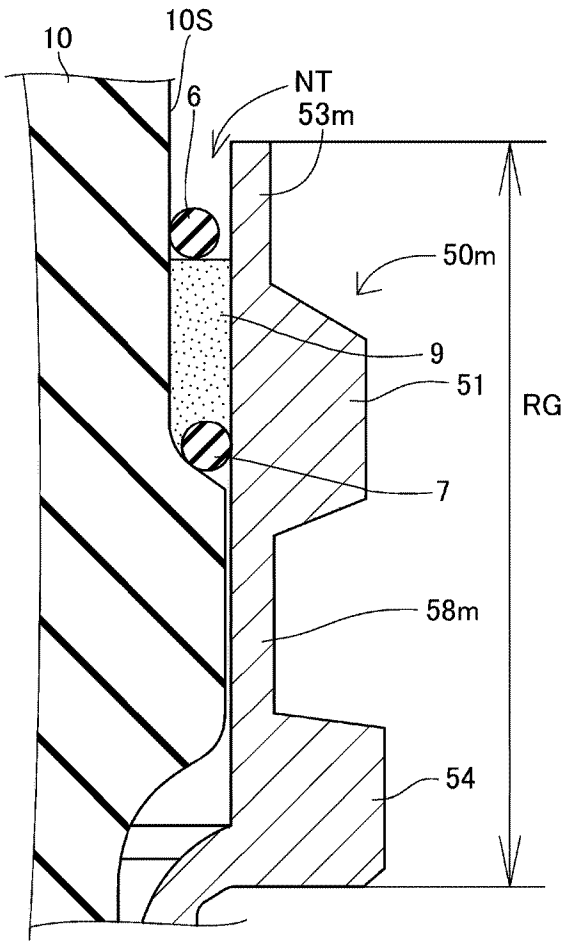
Figure 6:
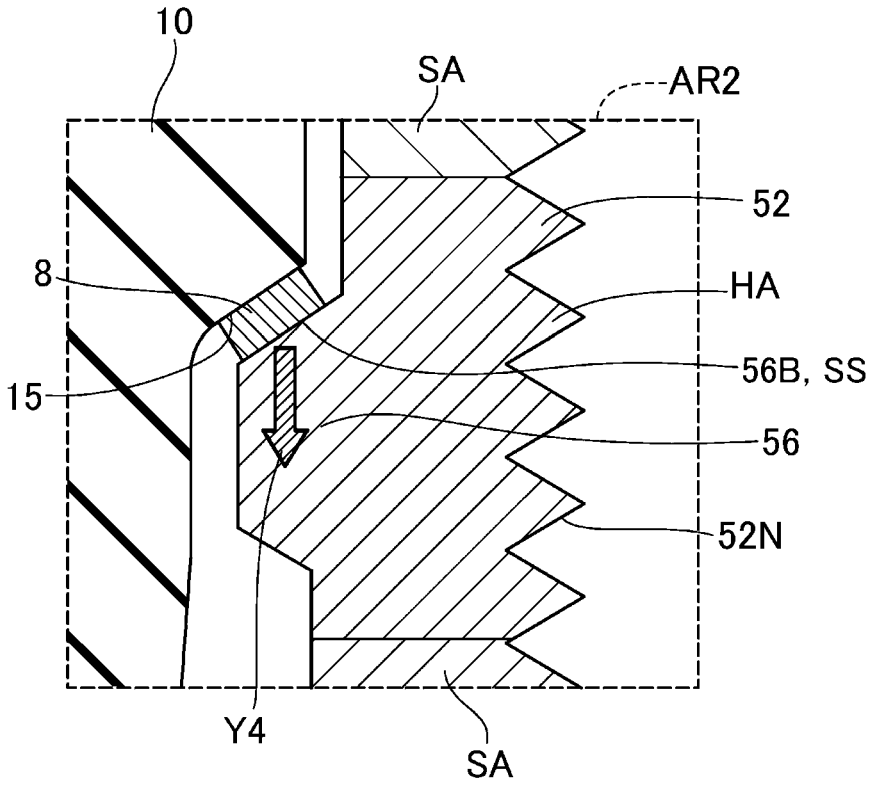
FIG. 6 is a second explanatory view of the crimping of the metal shell.

In S40, the insulator 10 is assembled onto the metal shell 50*m*. FIGS. 5A, 5B, and 6 are explanatory views of crimping of the metal shell. FIG. 5A illustrates the metal shell 50 in the pre-crimping state and the insulator 10. A rear end portion 53*m* of the metal shell 50 in the pre-crimping state is crimped in a state in which the ring members 6 and 7 and talc 9 are disposed between the rear end portion 53*m* and the outer circumference surface 10S of the insulator 10. As a result, as illustrated in FIG. 5B, the linear rear end portion 53*m* is formed into the curved rear end portion 53 in the cross section. The rear end portion 53*m* in the state shown in FIG. 5B is further pressed from the rear side toward the front side, as indicated by arrow Y1. As a result, in the cross section, a linear deformation portion 58*m* is deformed as indicated by arrow Y3, by being pressed, into the curved deformation portion 58. The flange portion 19 of the insulator 10 is pressed via the ring members 6 and 7 and talc 9 toward the front side as indicated by arrow Y2. As a result, the outer-diameter reduction surface 15 of the insulator 10 presses the rear end surface 56B (specific surface SS) of the stepped portion 56 via the plate packing 8 as indicated by arrow Y4 in FIG. 6. The pressing force deforms a stepped portion 56*m* having a non-distorted trapezoidal shape in cross section into the stepped portion 56 (FIG. 2B) having a distorted trapezoidal shape.

Thus, in S40, the rear end portion 53 is crimped, thereby the insulator 10 is secured to the metal shell 50 with the ring members 6 and 7 and talc 9 interposed therebetween from the rear side. Moreover, the plate packing 8 suppresses leakage of the gas inside the combustion chamber of the internal combustion engine to the outside from a clearance between the metal shell 50 and the insulator 10.

In S50, the ground electrode 30 is bent to form a clearance between the center electrode 20 and the ground electrode 30. In S60, the gasket 5 is attached to the metal shell 50 to complete the ignition plug 100.

In the ignition plug 100 according to the first embodiment described above, the average hardness of the surface layer portion HAs, which is included in the high-hardness portion HA, is higher than the average hardness of the rear end portion 53 and the average hardness of the deformation portion 58, which are included in the low-hardness portion SA. As a result, it is possible to suppress deformation of the stepped portion 56 of the metal shell 50 while ensuring easy deformability of the rear end portion 53 and the deformation portion 58 of the metal shell 50. Therefore, for example, it is possible to suppress cracking of the rear end portion 53 and the deformation portion 58 when the rear end portion 53 is crimped during the assembly (S30 in FIG. 4) of the insulator 10 and the metal shell 50. Moreover, for example, it is also possible to avoid a malfunction in which the insulator 10 is damaged by the stepped portion 56 deformed due to the force applied to the stepped portion 56 by the outer-diameter reduction surface 15 of the insulator 10 through the plate packing 8.

Specifically, if the hardness of the surface layer portion HAs of the stepped portion 56 is excessively low, the deformation amount of the stepped portion 56 in the assembly of the insulator 10 and the metal shell 50 becomes excessively large. In this case, for example, the amount of radially inward protruding of a portion close to the radially inward end of the rear end surface 56B of the stepped portion 56 is increased. Then, the protruding portion comes into contact with the outer circumference surface 10S of the insulator 10. Due to the contact, the insulator 10 may be scratched, which may lead to a malfunction in which insulating performance of the insulator 10 is degraded or may lead to breakage of the insulator 10.

In contrast, if the hardness of the rear end portion 53 and the hardness of the deformation portion 58 are excessively high, a malfunction in which the rear end portion 53 and the deformation portion 58 are cracked when being curved during the assembly of the insulator 10 and the metal shell 50 may be caused.

Therefore, if the metal shell 50 is formed to have the same hardness overall, for example, if the metal shell 50 is formed to have a low hardness overall to avoid breakage of the rear end portion 53 and the deformation portion 58, the deformation amount of the stepped portion 56 will be increased, which may lead to scratching or breakage of the insulator 10. Moreover, if the overall hardness of the metal shell 50 is increased to avoid scratching and breakage of the insulator 10, the rear end portion 53 and the deformation portion 58 may be cracked. According to the first embodiment, it is possible to avoid these malfunctions because the average hardness of the surface layer portion HAs is higher than the average hardness of the rear end portion 53 and the average hardness of the deformation portion 58.

For example, the Vickers hardness of each of five points P1 to P5 is measured. The points P1 to P5 are arranged at equal intervals on the line passing through the thickness direction center of the rear end portion 53 in the longitudinal direction of the rear end portion 53 in the cross section, as illustrated in FIG. 2A. The average Vickers hardness of the points P1 to P5 is calculated as the average hardness of the rear end portion 53. The Vickers hardness is measured in accordance with, for example, JIS Z2244:2009.

Similarly, the Vickers hardness of each of five points P6 to P10 are measured. The points P6 to P10 are arranged at equal intervals on the line passing through the thickness direction center of the deformation portion 58 in the longitudinal direction of the deformation portion 58 in the cross section, as illustrated in FIG. 2A. The average Vickers hardness of the five points P6 to P10 is calculated as the average hardness of the deformation portion 58.

In addition, the Vickers hardness of five points P11 to P15 are measured. The five points P11 to P15 are arranged at equal intervals on the line passing through the thickness direction center of the surface layer portion HAs in the longitudinal direction of the surface layer portion HAs in the cross section, as illustrated in FIG. 2B. The average Vickers hardness of the five points P11 to P15 is calculated as the average hardness of the surface layer portion HAs. The line passing through the thickness direction center of the surface layer portion HAs is, for example, a line spaced apart from the specific surface SS by 0.25 mm.

Moreover, in the first embodiment, the average hardness of the inner region HAa (FIG. 2B) of the stepped portion 56 in the cross section is higher than the average hardness of the rear end portion 53 and the average hardness of the deformation portion 58. Thus, it is possible to further suppress the deformation of the stepped portion 56 because not only the hardness of the surface layer portion HAs but also the hardness of the inner region HAa, which includes a portion closer than the surface layer portion HAs to the front side, is high. Therefore, it is possible to further suppress scratching or breakage caused in the insulator 10 by the deformation of the stepped portion 56.

Furthermore, in the first embodiment, the average hardness of the region HAd (FIG. 3A) positioned close to the rear end of the stepped portion 56 in the cross section is higher than the average hardness of the rear end portion 53 and the average hardness of the deformation portion 58. As a result, it is possible to suppress breakage (in other words, screw tearing) between the specific groove portion Vn and the rear end Pb, which is positioned radially outside of the outer-diameter reduction surface 15, of the stepped portion 56 during the assembly of the insulator 10 and the metal shell 50. When the insulator 10 and the metal shell 50 are assembled, the stepped portion 56 has a high hardness as a result of having being subjected to quenching. Thus, the deformation amount of the stepped portion 56 is small compared with the stepped portion 56 not subjected to quenching. The small deformation amount causes concentration of stress on a portion close to the radially outward end Pb of the rear end surface 56B of the stepped portion 56, and thus the portion is easily subjected to high stress. Therefore, in the first embodiment, it is possible to suppress screw tearing, which easily starts from the radially outward end Pb, by increasing the hardness of the region HAd close to the rear end of the stepped portion 56.

Similarly, in the first embodiment, the average hardness of each of the regions HAe1 and HAe2, which are positioned close to the rear end of the stepped portion 56 in the section in FIG. 3B, is higher than the average hardness of the rear end portion 53 and the average hardness of the deformation portion 58. As a result, it is possible to suppress screw tearing between the rear end Pb, which is positioned radially outside of the outer-diameter reduction surface 15, of the stepped portion 56 and the specific groove portions Vn1 and Vn2 during the assembly of the insulator 10 and the metal shell 50.

Moreover, in the first embodiment, in the cross section, the average hardness of each of the outer region HAb and the region HAc (FIG. 3A) adjacent to the stepped portion 56 is higher than the average hardness of the rear end portion 53 and the average hardness of the deformation portion 58. Thus, it is possible to suppress, in particular, deformation of the stepped portion 56 during the assembly of the insulator 10 and the metal shell 50, by increasing the hardness of a region around the stepped portion 56.

The aforementioned average hardness of each of the regions HAa, HAd, HAe1, HAe2, HAb, and HAc is calculated as described below. First, sufficient (for example, 5 to 10) measurement points evenly dispersed in a measurement target region are determined. Then, the Vickers hardness of each measurement point is measured, and the average of the Vickers hardness of the plurality of measurement points is calculated as the average hardness of the measurement target region.

Furthermore, in the ignition plug 100 according to the first embodiment, only the high-hardness portion HA, which includes the surface layer portion HAs, includes a martensite structure. The low-hardness portion SA, which includes the rear end portion 53 and the deformation portion 58, does not include a martensite structure. As a result, the hardness of the surface layer portion HAs is higher than the hardness of the rear end portion 53 and the hardness of the deformation portion 58. Therefore, as described above, it is possible to increase the strength of the stepped portion 56 of the metal shell 50 while ensuring easy deformability of the rear end portion 53 and the deformation portion 58.

For example, the ignition plug 100 is cleaved to expose the cross section including the axial line CO, and observed with a metallurgical microscope after the cross section is subjected to mirror polishing. Through the observation, presence or absence of a martensite structure in the cross section can be determined.

Only the high-hardness portion HA, which includes the inner region HAa (FIG. 2B) of the stepped portion 56, includes a martensite structure. The low-hardness portion SA, which includes the rear end portion 53 and the deformation portion 58, does not include a martensite structure. Thus, it is possible to further suppress the deformation of the stepped portion 56 because not only the hardness of the surface layer portion HAs but also the hardness of the inner region HAa, which includes the portion closer than the surface layer portion HAs to the front side, is higher than the hardness of the rear end portion 53 and the hardness of the deformation portion 58.

Moreover, in the first embodiment, only the high-hardness portion HA, which includes the regions HAd, HAe1, and HAe2 close to the rear end of the stepped portion 56, includes a martensite structure. The low-hardness portion SA, which includes the rear end portion 53 and the deformation portion 58, does not include a martensite structure. As a result, it is possible to suppress screw tearing in a portion close to the specific groove portions Vn, Vn1, and Vn2 because the hardness of the region HAd close to the rear end of the stepped portion is higher than the hardness of the rear end portion 53 and the hardness of the deformation portion 58.

Furthermore, in the first embodiment, the diameter of the screw portion 52N is equal to or less than M12. When the screw portion 52N has a diameter equal to or less than M12, each of the metal shell 50 and the stepped portion 56 tends to have a thin thickness; thus, ensuring the strength of the stepped portion 56 is difficult, which increases the necessity of suppressing deformation of the stepped portion 56. According to the aforementioned structure, it is possible to suppress deformation of the stepped portion 56 in the ignition plug 100 having such high necessity of suppressing the deformation of the stepped portion 56.

The method (FIG. 4) of manufacturing the ignition plug 100 according to the first embodiment includes a first step (S10 in FIG. 4) of preparing the metal shell 50 and the insulator 10, a second step (S20 in FIG. 4) of subjecting only the high-hardness portion HA of the metal shell 50 to quenching, and a third step (S40 in FIG. 4) of assembling the insulator 10 onto the quenched metal shell 50. According to the method, it is possible to avoid a malfunction (scratching and breakage of the insulator 10) caused by the excessive deformation of the stepped portion 56 while suppressing cracking of the rear end portion 53 and the deformation portion 58 during crimping.

As the above description shows, the inner region HAa according to the first embodiment is an example of the first region, and each of the regions HAd, HAe1, and HAe2 close to the rear end of the stepped portion 56 is an example of the second region. The high-hardness portion HA is an example of a first portion, and the low-hardness portion SA is an example of a second portion.

B. Second Embodiment

Figure 7:
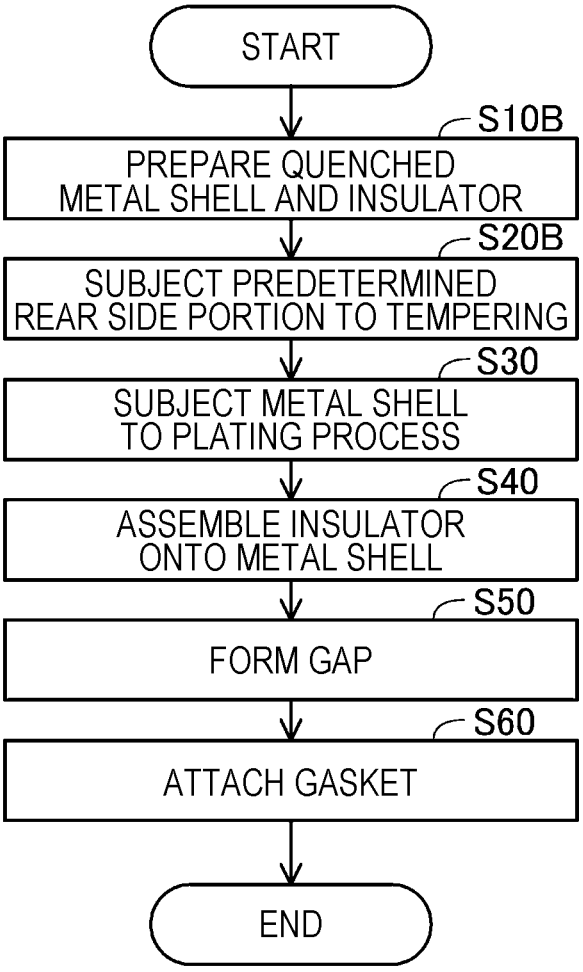
FIG. 7 is a flow chart showing manufacturing steps of an ignition plug according to a second embodiment.

FIG. 7 is a flow chart showing manufacturing steps of the ignition plug 100 according to a second embodiment. In S10B, the metal shell 50*m*, which is in a pre-crimping state, and the insulator 10 are prepared. Note that in the second embodiment, the whole metal shell 50*m* is subjected to a quenching process, and thus, a martensite structure is included in the whole metal shell 50*m*. The metal shell 50*m* that includes the martensite structure overall is manufactured by, for example, performing quenching or by performing quenching and low-temperature tempering with use of a publicly known heat-treatment furnace; or the metal shell 50*m* is manufactured by subjecting predetermined pre-hardened steel (quenched steel material) to a cutting process. The insulator 10 is the same as the insulator 10 prepared by the manufacturing method (FIG. 4) according to the first embodiment.

In S20B, partial tempering is performed on a portion of the metal shell 50*m*, the portion including the rear end portion 53 on the rear side and the deformation portion 58 and not including the stepped portion 56, so that the hardness of the portion including the rear end portion 53 and the deformation portion 58 becomes lower than the hardness of a portion including the stepped portion 56. The partial tempering is performed by using, for example, a high-frequency heater. For example, when the portion including the rear end portion 53 and the deformation portion 58 is subjected to high-temperature tempering, the martensite structure in the portion disappears, and the structure of the portion transforms into a sorbite structure (two-phase structure of fine cementite and ferrite). The portion to be subjected to tempering is, for example, a portion within an area RG, shown in FIG. 5A, extending in the axial line direction; that is, a portion that includes the rear end portion 53, the tool engagement portion 51, the deformation portion 58, and the jutting portion 54. The portion not subjected to tempering; that is, the portion maintained in a state in which the martensite structure is contained is a portion closer than the area RG to the front side; that is, a portion including the attachment portion 52 and the stepped portion 56.

Processes in S30 to S60 in FIG. 7 are the same as those in S30 to S60 in FIG. 4; thus will not be described.

According to the second embodiment described above, the manufacturing method (FIG. 4) includes a first step (S10B in FIG. 7) of preparing the insulator 10 and the metal shell 50 whose whole portion, which includes the portion to become the high-hardness portion and the portion to become the low-hardness portion, has been subjected to quenching, a second step (S20B in FIG. 7) of subjecting the metal shell 50 to tempering, the tempering being performed only on the portion to become the low-hardness portion (the portion including the deformation portion 58 and the rear end portion 53), and a third step (S30 in FIG. 7) of assembling the insulator 10 onto the tempered metal shell 50. According to this manufacturing method, as is in the first embodiment, the hardness of the high-hardness portion (non-tempered portion) becomes higher than the hardness of the portion (tempered portion) including the rear end portion 53 and the deformation portion 58 in S20B. Therefore, as is in the first embodiment, it is possible to avoid a malfunction (scratching or breakage of the insulator 10) caused by excessive deformation of the stepped portion 56 while suppressing cracking of the rear end portion 53 and the deformation portion 58 during the crimping.

C. Modification (1) In the manufacturing method according to the first embodiment, laser beam quenching is employed as quenching in S20 in FIG. 4. As an alternative to laser beam quenching, high-frequency quenching may be employed. Laser beam quenching has a drawback such that a quenchable depth is shallower than in high-frequency quenching, but has advantages such that low-temperature tempering and a cooling treatment that uses a cold agent are not required and that deformation (distortion) of members as a result of quenching is small. An appropriate quenching method is selected in accordance with the thickness and the size of the metal shell 50 to be manufactured.

If low-carbon steel is used as a material of the metal shell 50 and the low-carbon steel does not contain a sufficient amount of carbon to form a martensite structure, a carburizing treatment to increase the carbon concentration of the portion to become the high-hardness portion HA may be performed before quenching.

(2) Each of the areas (FIGS. 2A and 2B) of the high-hardness portion HA and the low-hardness portion SA of the metal shell 50 according to the first embodiment is a non-limiting example. The high-hardness portion HA may include only the surface layer portion HAs. Moreover, the high-hardness portion HA may include only the inner region HAa (including the surface layer portion HAs). Furthermore, the high-hardness portion HA may be a region that includes only the surface layer portion HAs and the regions HAd, HAe1, and HAe2 close to the rear end of the stepped portion 56. Thus, preferably, the high-hardness portion HA includes at least the surface layer portion HAs.

Similarly, the surface layer portion HAs may be the only portion that includes the martensite structure. Moreover, the inner region HAa (including the surface layer portion HAs) may be the only portion that includes the martensite structure. Furthermore, the portion that includes the martensite structure may be a region that includes only the surface layer portion HAs and the regions HAd, HAe1, and HAe2 close to the rear end of the stepped portion 56. Thus, preferably, the portion that includes the martensite structure includes at least the surface layer portion HAs.

The low-hardness portion SA may be an area that includes at least the rear end portion 53 and the deformation portion 58 and may be an area that includes only the rear end portion 53 and the deformation portion 58. Specifically, in S20B in FIG. 7 according to the second embodiment, only the rear end portion 53 and the deformation portion 58 may be subjected to tempering.

Similarly, the portion that does not include a martensite structure may be an area that includes at least the rear end portion 53 and the deformation portion 58 or may be an area that includes only the rear end portion 53 and the deformation portion 58.

(3) The specific structure of the ignition plug 100 according to the first embodiment is a non-limiting example. For example, the plate packing 8 may be omitted, and the outer-diameter reduction surface 15 of the insulator 10 may be directly pressed against the rear end surface 56B of the stepped portion 56. Moreover, the ring members 6 and 7 and the talc 9 may be omitted, and the portion where the ring members 6 and 7 and the talc 9 are omitted may be a portion of the metal shell 50. In other words, a clearance in which the ring members 6 and 7 and the talc 9 should have been disposed may be solid. In this case, when the rear end portion 53 is pressed, a portion of the metal shell including the rear end portion 53 may be directly pressed against the flange portion 19 of the insulator 10.

The diameter of the screw portion 52N may be larger than M12, such as M14 or M16.

For example, the material, dimensions, shape, and the like of each of the ground electrode 30, the center electrode 20, insulator 10, and the like may be varied. For example, zing plating or nickel plating may be omitted in the metal shell 50. Moreover, any insulating ceramic other than alumina may be employed as the material of the insulator 10.

The present invention is described above on the basis of the embodiments and the modification; however, the aforementioned embodiments of the invention are only for easy grasping of the present invention and should not be construed as limiting the invention in any way. The present invention may be varied or modified without deviating from the concept and the claims of the invention and includes equivalents of the invention.

Having described the invention, the following is claimed:

1. An ignition plug comprising:

an insulator that is a cylindrical body extending in a direction of an axial line and has an outer-diameter reduction surface where an outer diameter is reduced toward a front side; and a cylindrical metal shell that is disposed on an outer circumference of the insulator, the metal shell including:

a rear end portion that is curved further toward an outer circumference surface of the insulator as the rear end portion becomes closer to a rear side, the rear end portion securing the insulator from the rear side directly or via another member;

a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member, wherein when in having projected the outer-diameter reduction surface of the insulator onto a rear end surface of the stepped portion along the axial line, the rear end surface includes a specific surface that is a surface overlapped by the projected outer-diameter reduction surface, in a section including the axial line, an average hardness of a surface layer portion extending along the specific surface is higher than an average hardness of the rear end portion and an average hardness of the deformation portion.

2. The ignition plug according to claim 1, wherein the stepped portion includes the rear end surface, a front end surface positioned closer than the rear end surface to the front side and where an inner diameter is increased toward the front side, and an intermediate surface positioned between the rear end surface and the front end surface, wherein in the section, when the stepped portion includes a first region between a line that indicates the specific surface and a straight line that passes through a front end of a line indicating the intermediate surface and that is perpendicular to the axial line, the first region extending radially inwardly from a straight line that passes through a radially outward end of the line indicating the specific surface and that extends along the axial line, an average hardness of the first region is higher than the average hardness of the rear end portion and the average hardness of the deformation portion.

3. The ignition plug according to claim 1, wherein the metal shell includes a screw portion formed in at least an area of an outer circumference surface of the metal shell, the area extending in the direction of the axial line and being where the rear end surface of the stepped portion is formed, wherein in the section, when the screw portion includes a plurality of groove portions, the plurality of groove portions including a specific groove portion that is closest to a radially outward end of the rear end surface, when the screw portion includes a plurality of ridge portions, the plurality of ridge portions including two specific ridge portions that are adjacent to the specific groove portion, and when the metal shell includes a second region between two straight lines that pass through one of the specific ridge portions corresponding thereto and that are perpendicular to the axial line, the second region extending radially outwardly from a straight line that passes through the radially outward end of the rear end surface and that extends along the axial line, an average hardness of the second region is higher than the average hardness of the deformation portion and the average hardness of the rear end portion.

4. The ignition plug according to claim 1, wherein the screw portion has a diameter less than or equal to M12.

5. An ignition plug comprising:

an insulator that is a cylindrical body extending in a direction of an axial line and has an outer-diameter reduction surface where an outer diameter is reduced toward a front side; and a cylindrical metal shell that is disposed on an outer circumference of the insulator, the metal shell including:

a rear end portion that is curved further toward an outer circumference surface of the insulator as the rear end portion becomes closer to a rear side, the rear end portion securing the insulator from the rear side directly or via another member;

a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member, wherein when in having projected the outer-diameter reduction surface of the insulator onto a rear end surface of the stepped portion along the axial line, the rear end surface includes a specific surface that is a surface overlapped by the projected outer-diameter reduction surface, in a section including the axial line, a martensite structure is included only in a region including at least the surface layer portion that extends along the specific surface and excluding the rear end portion and the deformation portion.

6. The ignition plug according to claim 5, wherein the stepped portion includes the rear end surface, a front end surface positioned closer than the rear end surface to the front side and where an inner diameter is increased toward the front side, and an intermediate surface positioned between the rear end surface and the front end surface, wherein in the section, when the stepped portion includes a first region between a line that indicates the specific surface and a straight line that passes through a front end of a line indicating the intermediate surface and that is perpendicular to the axial line, the first region extending radially inwardly from a straight line that passes through a radially outward end of the line indicating the specific surface and that extends along the axial line, the first region includes the martensite structure.

7. The ignition plug according to claim 5, wherein the metal shell includes a screw portion formed in at least an area of an outer circumference surface of the metal shell, the area extending in the direction of the axial line and being where the rear end surface of the stepped portion is formed, wherein in the section, when the screw portion includes a plurality of groove portions, the plurality of groove portions including a specific groove portion that is closest to a radially outward end of the rear end surface, when the screw portion includes a plurality of ridge portions, the plurality of ridge portions including two specific ridge portions that are adjacent to the specific groove portion, and when the metal shell includes a second region between two straight lines that pass through one of the specific ridge portions corresponding thereto and that are perpendicular to the axial line, the second region extending radially outwardly from a straight line that passes through the radially outward end of the rear end surface and that extends along the axial line, the second region includes the martensite structure.

8. A method of manufacturing an ignition plug having an insulator that is a cylindrical body extending in a direction of an axial line and has an outer-diameter reduction surface where an outer diameter is reduced toward a front side; and a cylindrical metal shell that is disposed on an outer circumference of the insulator, the metal shell including:

a rear end portion that is curved further toward an outer circumference surface of the insulator as the rear end portion becomes closer to a rear side, the rear end portion securing the insulator from the rear side directly or via another member;

a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member, the method comprising:

a first step of preparing the metal shell and the insulator;

a second step of subjecting only a first portion of the metal shell to quenching; and a third step of assembling the insulator onto the metal shell after the quenching, wherein the third step includes crimping a rear end of the metal shell to form the rear end portion and the deformation portion and pressing the outer-diameter reduction surface of the insulator against the rear end surface directly or via another member, wherein in a section of a spark plug intermediate body after the third step, the first portion includes the surface layer portion extending along the specific surface of the stepped portion, and wherein a second portion, other than the first portion, includes portions that are deformed in the third step into the rear end portion and the deformation portion.

9. A method of manufacturing an ignition plug having an insulator that is a cylindrical body extending in a direction of an axial line and has an outer-diameter reduction surface where an outer diameter is reduced toward a front side; and a cylindrical metal shell that is disposed on an outer circumference of the insulator, the metal shell including:

a rear end portion that is curved further toward an outer circumference surface of the insulator as the rear end portion becomes closer to a rear side, the rear end portion securing the insulator from the rear side directly or via another member;

a deformation portion that is positioned closer than the rear end portion to the front side and is curved so as to jut out radially outwardly; and a stepped portion that is positioned closer than the deformation portion to the front side and juts out radially inwardly, the stepped portion supporting the outer-diameter reduction surface of the insulator from the front side directly or via another member, the method comprising:

a first step of preparing the metal shell and the insulator, the metal shell including a quenched portion, the quenched portion including a first portion and a second portion;

a second step of subjecting only the second portion of the metal shell to tempering; and a third step of assembling the insulator onto the metal shell after the tempering, wherein the third step includes crimping a rear end of the metal shell to form the rear end portion and the deformation portion and pressing the insulator against the rear end surface directly or via another member, wherein in a section of a spark plug intermediate body after the third step, the first portion includes the surface layer portion extending along the specific surface of the stepped portion, and wherein the second portion, other than the first portion, includes portions that are deformed in the third step into the rear end portion and the deformation portion.

* * * * *